US009564719B1

(12) United States Patent
Oldham et al.

(10) Patent No.: US 9,564,719 B1
(45) Date of Patent: Feb. 7, 2017

(54) ELEVATED TEMPERATURE DETECTION AND INTERRUPTER CIRCUIT FOR POWER CABLE

(71) Applicant: TECHNOLOGY RESEARCH, LLC, Clearwater, FL (US)

(72) Inventors: Donald Oldham, Clearwater, FL (US); Jon B Freeman, Palm Harbor, FL (US); Hamze Moussa, Palm Harbor, FL (US)

(73) Assignee: Technology Research LLC., Clearwater, FL (US)

( * ) Notice: Subject to any disclaimer, the term of this patent is extended or adjusted under 35 U.S.C. 154(b) by 0 days.

(21) Appl. No.: 14/967,243

(22) Filed: Dec. 11, 2015

Related U.S. Application Data

(60) Provisional application No. 62/091,049, filed on Dec. 12, 2014.

(51) Int. Cl.

| | |
|---|---|
| ***H01R 13/66*** | (2006.01) |
| ***H01R 13/713*** | (2006.01) |
| ***H01R 27/02*** | (2006.01) |
| ***H01R 43/16*** | (2006.01) |

(52) U.S. Cl.
CPC ..... *H01R 13/7137* (2013.01); *H01R 27/02* (2013.01); *H01R 43/16* (2013.01)

(58) Field of Classification Search
CPC ..... H01R 13/7137; H01R 43/16; H01R 27/02; H01R 13/6683; H01R 13/68; H02J 3/14; G08B 13/1409; B65H 75/40; H20H 5/043
USPC ..... 439/620.21
See application file for complete search history.

(56) References Cited

U.S. PATENT DOCUMENTS

| | | | | |
|---|---|---|---|---|
| 5,900,804 | A * | 5/1999 | Yewell | G08B 13/1409 324/508 |
| 8,159,803 | B2 * | 4/2012 | Ward | H01R 13/7135 361/103 |
| 8,325,454 | B2 * | 12/2012 | Brugner | H01R 13/6683 361/103 |
| 8,700,224 | B2 * | 4/2014 | Mathiowetz | H02J 3/14 307/85 |
| 8,878,397 | B2 * | 11/2014 | Tracey | B65H 75/40 307/147 |
| 8,922,967 | B2 * | 12/2014 | Goelz | H02H 5/043 361/103 |
| 2007/0139842 | A1 * | 6/2007 | De' Longhi | H01R 13/68 361/103 |
| 2009/0251832 | A1 * | 10/2009 | Brugner | H01R 13/6683 361/42 |

* cited by examiner

*Primary Examiner* — Jean F Duverne
(74) *Attorney, Agent, or Firm* — Frijouf, Rust & Pyle P.A.

(57) ABSTRACT

A circuit is disclosed for disconnecting electrical power upon the detection of an elevated temperature comprising an electrical plug and an electrical receptacle interconnected by a power cable. An interruption circuit having a disconnect switch is interposed in the power cable. A plug heat sensitive device and a receptacle heat sensitive device monitor the temperature of the electrical plug and the electrical receptacle. An elevated temperature detection circuit opens the disconnect switch upon the detection of an elevated temperature in one of the electrical plug and the electrical receptacle to prevent an overheated condition.

18 Claims, 11 Drawing Sheets

ELEVATED TEMPERATURE DETECTION AND INTERRUPTER CIRCUIT FOR POWER CABLE

CROSS-REFERENCE TO RELATED APPLICATIONS

This application claims benefit of U.S. Patent Provisional application No. 62/091,049 filed Dec. 12, 2014. All subject matter set forth in provisional application No. 62/091,049 filed Dec. 12, 2014 is hereby incorporated by reference into the present application as if fully set forth herein.

BACKGROUND OF THE INVENTION

Field of the Invention

This invention relates to electricity and more particularly to an elevated temperature detection and interrupter circuit for a power cable to disconnect electrical power upon the detection of an elevated temperature in an electrical plug or an electrical receptacle to prevent an over heated condition.

Description of the Related Art

The most common method of connecting an electrical appliance to an electric power source is through the use of an electrical power plug inserted into an electrical power source receptacle. The electrical power plug includes a first and a second electrical blade for insertion within a first and a second slot of the power source receptacle. The first and second electrical blades are retained within the first and second slots of the electrical power source receptacle by a resilient slot connector located within the first and second slots of the electrical power source receptacle. The resilient slot connectors located within the first and second slot provides a mechanical engagement between the resilient slot connectors and the inserted first and second electrical blades to enable a low resistance electrical contact therebetween.

In many cases, the mechanical and/or electrical contact between one of the resilient slot connectors and the inserted first and second electrical blades deteriorates thus raising the electrical resistance of the electrical contact therebetween. This deterioration of the mechanical and/or electrical contact between one of the resilient slot connectors and the inserted first and second electrical blades may be caused by a number of reasons.

The deterioration between one of the resilient slot connectors and the inserted electrical blade may be caused by corrosion of either the resilient slot connector and/or the inserted electrical blade. The corrosion of either the resilient slot connector and/or the inserted electrical blade results in an increase in electrical resistance therebetween. Furthermore, the deterioration between one of the resilient slot connectors and the inserted electrical blade may be caused by a loss of resiliency of the resilient slot connectors. The loss of resiliency of the resilient slot connector reduces the mechanical contact between the resilient slot connector and the inserted electrical blade thus raising the electrical resistance of the electrical contact therebetween. In some instances, the mere aging of the electrical power plug and/or electrical power source receptacle may cause a loss of resiliency of the resilient slot connector as well as the corrosion of either the resilient slot connector and/or the inserted electrical blade.

The increase in resistance between the resilient slot connector and/or the inserted electrical blade results in an increase in heat during current conduction through the electrical contact between the resilient slot connector and the inserted electrical blade. The increase in heat further increases the resistance of the electrical contact between the resilient slot connector and the inserted electrical blade resulting in a progressive increase in heat and a progressive increase in electrical resistance. Ultimately, the progressive increase in heat will result in heat, smoking and possibly ignition of the electrical power source receptacle and/or the electrical power plug. Such an ignition may spread to adjacent areas causing loss of property and possibly the loss of life.

U.S. Pat. No. 4,310,837 to Kornrumpf et al. discloses a temperature indicating apparatus for sensing overheating at a pair of terminals on an electrical power line comprising a neon gas-filled glow tube and a thermistor electrically coupled in series across the terminals, with a resistor electrically coupled in parallel with the glow tube. The thermistor is thermally coupled to the terminations so that an excessive temperature rise at either terminal decreases the thermistor resistance to a level at which sufficient voltage appears across the glow tube to ignite the glow tube and provide a visual indication of overheating. The circuit readily lends itself to a plug-in type configuration if the terminals to be monitored are in a duplex receptacle, or to employment in a cube tap.

U.S. Pat. No. 4,470,711 to Brzozowski discloses a temperature indicating apparatus for sensing overheating at a pair of terminals on an electrical power line comprising pair of thermocouples, each thermally coupled to and electrically isolated from a different one of the terminals, and a light emitting diode (LED) coupled to the output of the thermocouples through a conditioning circuit. An excessive temperature rise at either terminal causes the output voltage of the thermocouple coupled thereto to increase, thus causing the LED to be lit and to provide a visual indication of overheating. A meter display may be provided to show the actual temperature of the terminals in response to thermocouple voltage output. A method for determining heating at a termination without physical intervention comprises determining the rate of temperature rise of the termination for a known current therethrough and comparing the rate to a predetermined rate threshold.

U.S. Pat. No. 5,590,010 to Ceola et al. discloses an electric device provided as an interface between a permanent power source (e.g., an electric wall outlet) and an electrical appliance for interrupting electrical power to the appliance in the event the temperature of either the power cord plug of the electrical appliance or permanent power source rises above a predetermined temperature. The electric device detachably couples to the electric power terminals of both the permanent power source and electrical appliance and is sensitive to the temperature of the aforementioned terminals. The electric device includes first and second temperature switching elements which are responsive to interrupt electrical power from the permanent power source to the appliance when either of the terminals is of a temperature which equates with a first predetermined temperature determined by the first temperature switching element or a second predetermined temperature determined by the second temperature switching element.

U.S. Pat. No. 5,600,306 to Ichikawa et al. discloses an electrical receptacle unit including at least one receptacle body internally provided with a pair of slotted terminals for insertion of a pair of blades of a load-side electrical plug. A thermistor is encased in a protective tube outwardly projectable from between the slotted terminals of the receptacle body. A coil spring is provided for projecting the thermistor out from the receptacle body. A relay enables and disables supply of electric power to the slotted terminals. A control circuit operates the relay to cut off supply of electric power to the slotted terminals when the temperature of the thermistor reaches or exceeds a preset temperature. A buzzer is operated by an output signal produced by the control circuit when the temperature of the thermistor reaches or exceeds the preset temperature. When the thermistor rises to or above the preset temperature owing to tracking or the like, supply of power to the load-side plug is cut off and the alarm is activated to produce a warning that the load-side plug has overheated.

U.S. Pat. No. 5,862,030 to Watkins, Jr. et al. discloses an electrical safety device comprising a sensor strip disposed in the insulation of a wire or in the insulation of a sheath enclosing a bundle of insulated electrical conductors. The sensor strip comprises a distributed over temperature sensing portion comprising a conductive polymer having a positive temperature coefficient of resistivity which increases with temperature sufficient to result in a switching temperature. A mechanical damage sensing portion comprises a strip disposed in the sheath in a mechanical damage sensing pattern which becomes damaged or open upon mechanical damage of the sheath before the bundle of conductors are damaged. The over temperature sensing portion and the mechanical damage sensing portion may be the same sensing strip disposed in the sheath and arranged in a helical relationship with a longitudinal axis of the sheath.

U.S. Pat. No. 5,930,097 to Ceola et al discloses an electric device provided as an interface between a permanent power source (e.g., an electric wall outlet) and an electrical appliance. The device operates to interrupt electrical power to the electrical appliance in response to an increase in temperature of either the power cord plug of the electrical appliance or the terminals of the permanent power source to a predetermined temperature. The electric device detachably couples to the electric power terminals of both the permanent power source and the electrical appliance and is sensitive to the temperature at the terminals. The device includes a thermostat which rests on a thermal barrier member in thermal communication with the terminals, and is responsive to heat generated at the terminals to interrupt electrical power from the permanent power source to the appliance.

U.S. Pat. No. 5,945,903 to Reddy et al discloses a circuit protection device including a pair of terminals to be electrically connected into an electrical circuit, a pair of spaced current-carrying extensions of the terminals, and an initially low resistance current limiting device extending between the current-carrying extensions. The invention includes the feature that the current-limiting element including flexible conductive current-feeding arms having inner and outer end portions, the inner end portions thereof being electrically connected to the current-carrying extensions of the terminals. The outer end portions of the current-feeding arms are cantilevered and flexible relative to the inner end portions. The device further preferably includes a PTC current-limiting element sandwiched between the flexible outer end portions of the current-feeding arms. The PTC element includes a layer of a PTC material having conductive opposite faces sandwiched between the flexible outer end portions of the arms so that the PTC material carries current between the outer end portions of the current carrying arms. The layer of PTC material reaches a given trip level at an elevated current, expanding suddenly and substantially to flex the outer end portions of the current carrying arm.

U.S. Pat. No. 7,508,642 to Ye discloses a virtual II T trip criterion implemented in an electrical power distribution system to provide current-based tripping for a solid state power switching device. A first-order system model is implemented either by hardware or software to represent a rise in temperature of the electrical wire through which power is supplied. When the simulated temperature exceeds a threshold, the solid state power switching device may be tripped.

U.S. Patent Application 2007/0139842 to De'Longhi discloses a plug adapted to fit in a standard electrical outlet and supply power through a cord to an electrical device provided with a thermostat and bistable resettable switch. When one of the plug's prongs is overheated, indicating an overload or short circuit, the thermostat actuates the switch and cuts off power to the electrical device. When the malfunction is repaired, the switch is reset to restore the circuit.

U.S. Pat. No. 8,325,454 to Brugner et al. discloses an over heating detection circuit and an interrupter circuit for interrupting electrical power upon the detection of an over heating condition of an electrical plug. A heat sensitive device monitors the temperature of the electrical plug. The over heating detection circuit is connected to the heat sensitive device for detecting an over heated condition. The interruption circuit includes a disconnect switch connected to the over heating detection circuit for disconnecting electrical power upon the detection of the over heated condition in the electrical plug.

U.S. Pat. No. 8,884,773 to Wiesemann et al. discloses a shore power cord including a power supply connector electrically connected to a vehicle connector. In some cases, the vehicle connector includes features to selectively secure the vehicle connector to a vehicle power receptacle inlet. In some cases, the shore power cord includes a test module that evaluates the condition of the cord set and a power supply when the cord set is connected to the power supply.

Although the above prior art has contributed to the advancement of the art, there is a need for an elevated temperature detection and interrupter circuit for disconnecting electrical power in a power cable.

Therefore, it is an object of the present invention to provide an elevated temperature detection and interrupter circuit for a power cable for disconnecting electrical power upon the detection of the over heated condition in an electrical plug or and electrical receptacle to prevent an over heated condition.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved circuit for disconnecting electrical power upon the detection of an elevated temperature, comprising an electrical plug adapted for insertion in an electrical power source and an electrical receptacle adapted for receiving an electrical load. A power cable interconnects the electrical plug and the electrical receptacle. An interruption circuit having a disconnect switch is interposed in the power cable. A plug heat sensitive device is secured to the electrical plug for monitoring the temperature of the electrical plug. A receptacle heat sensitive device is secured to electrical receptacle for monitoring the temperature of the electrical receptacle. An elevated temperature detection circuit is connected to the plug heat sensitive device and the receptacle heat sensitive device for opening the disconnect switch upon the over elevated temperature circuit detecting an elevated temperature in one of the electrical plug and the electrical receptacle to prevent an over heated condition.

Preferably, the disconnect switch is located external to the electrical plug and the electrical receptacle and interposed in the power cable between the electrical plug and the electrical receptacle with the elevated temperature detection circuit located adjacent to the disconnect switch. In one example, the disconnect switch comprises a spring loaded relay switch.

In a more specific embodiment, the electrical plug comprises an electrical plug housing supporting a first and a second electrical blade for insertion within a first and a second slot of the power source. The plug heat sensitive device is located in the electrical plug housing for monitoring the temperature of each of the first and second electrical blades. Similarly, the electrical receptacle comprises an electrical receptacle housing supporting a first and a second electrical slot for receiving the electrical load. The receptacle heat sensitive device is located in the electrical receptacle housing for monitoring the temperature of each of the first and second electrical slots.

In still a more specific embodiment of the invention, the elevated temperature detection circuit includes a plug voltage divider circuit and a receptacle divider circuit. The plug heat sensitive device comprises a plug thermistor connected between a neutral line and the plug voltage divider circuit of the elevated temperature detection circuit. The receptacle heat sensitive device comprises a receptacle thermistor connected between a neutral line and the receptacle voltage divider circuit of the elevated temperature detection circuit. The elevated temperature detection circuit includes a microprocessor circuit having an input gate. The plug voltage divider circuit and a receptacle divider circuit connected to the input gate of the microprocessor circuit. Preferably, a closure is located between the electrical plug and the electrical receptacle for housing the elevated temperature detection circuit and the interruption circuit.

The invention is also incorporated into the method of forming an electrical plug with a plug heat sensitive device for detecting an elevated temperature to prevent an over heated condition. The method comprises the steps of molding a first housing portion of the electrical plug from a polymeric material. A first and a second electrical blade are molded into the first housing portion of the electrical plug. A power cable is connected to the first and second electrical blades. A plug heat sensitive device is positioned adjacent to the first and second electrical blades. The plug heat sensitive device is connected to the power cable. A second housing portion is molded onto the first housing portion to capture the first and second electrical blades and the plug heat sensitive device within the electrical plug. A similar method is employed for forming an electrical receptacle with a receptacle heat sensitive device for detecting an elevated temperature.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
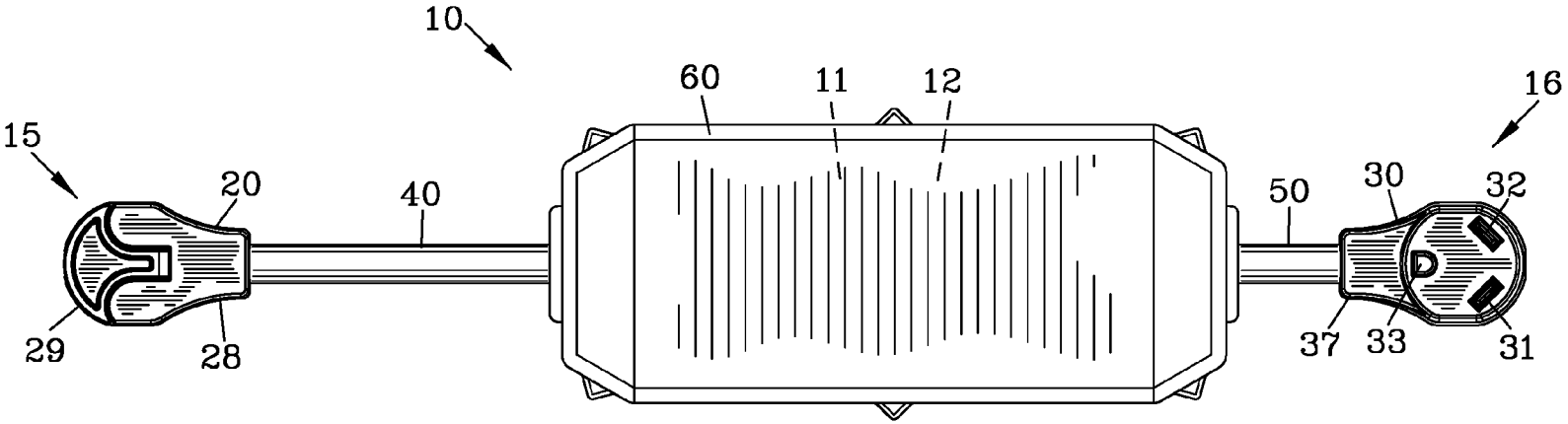
FIG. 1 is a top view of a first embodiment of a power cable incorporating an elevated temperature detection and interrupter circuit incorporating the present invention.
Figure 2:
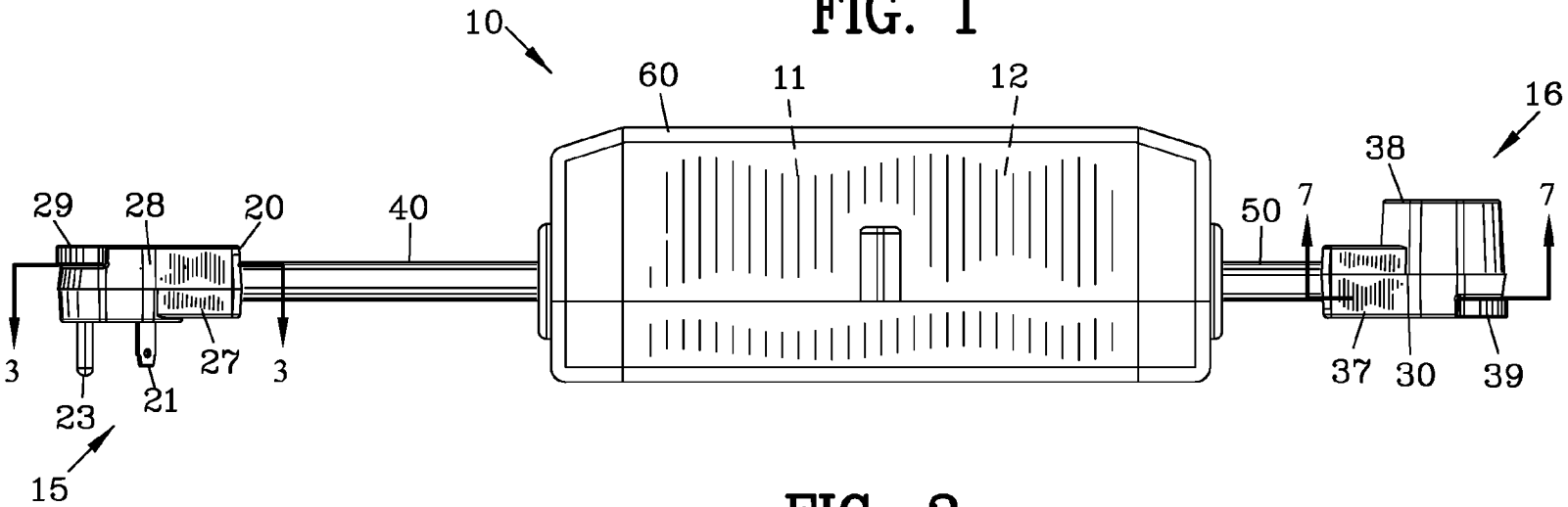
FIG. 2 is a side view of FIG. 1.

FIGS. 1-2 illustrate a first embodiment of an elevated temperature detection and interruption circuit 10 of the present invention. The elevated temperature detection and interruption circuit 10 disconnects power between a power source 15 and a load 16 upon the detection of an elevated temperature condition in an electrical plug 20 and/or an electrical receptacle 30 to prevent an overheated condition.

The electrical plug 20 and the electrical receptacle 30 are connected by a power cable comprising power cables 40 and 50 with a closure 60 interposed therebetween. A portion of a detection circuit 11 and an interruption circuit 12 are contained in the closure 60.

The electrical plug 20 is adapted to be connected to a conventional 120 volt 30 ampere power source 15. The electrical receptacle 30 is adapted to be connected to a conventional 120 volt load 16.

Figure 3:
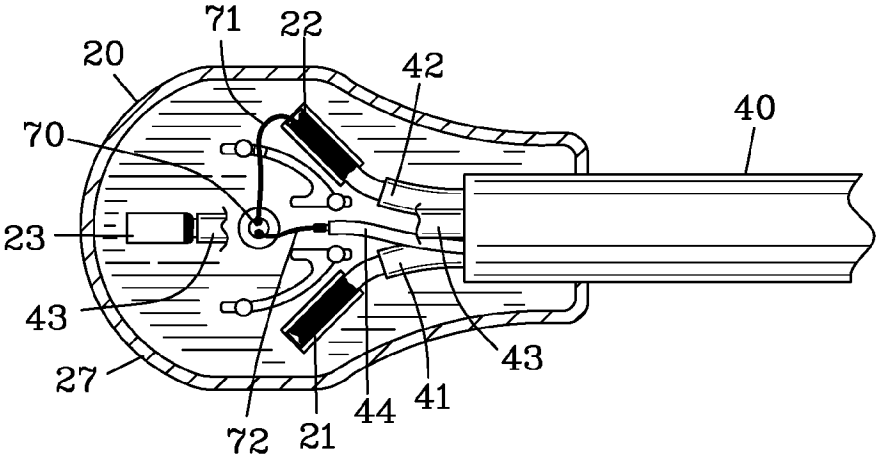
FIG. 3 is an enlarged view along line 3-3 in FIG. 2 showing an initial first portion of a plug shown in FIG. 1.
Figure 4:
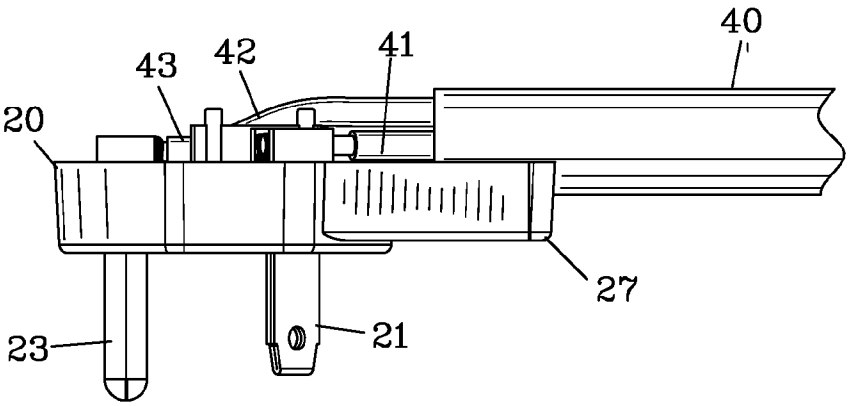
FIG. 4 is a side view of FIG. 3.

FIGS. 3 and 4 are enlarged interior views of the electrical plug 20 of FIGS. 1 and 2. The electrical plug 20 includes a first and a second electrical blade 21 and 22 and a ground lug 23. The first and second electrical blades 21 and 22 and the ground lug 23 are molded into a first housing portion 27 of the electrical plug 20.

The power cable 40 connects the electrical plug 20 to the closure 60. The power cable 40 comprises a first and a second conductor 41 and 42 and a ground conductor 43. The first and second blades 21 and 22 of the plug 20 are connected to the first and a second conductor 41 and 42 of the power cable 40. The ground lug 23 of the plug 20 is connected to the ground conductor 43. The first conductor 41 is shown as a line conductor whereas the second conductor 42 is shown as a neutral conductor. The power cable 40 includes a plug sensor wire 44 the function of which will be described in greater detail hereinafter. Although the electrical plug 20 has been shown to include the ground lug 23, it should be understood that the present invention can be used with an electrical plug 20 having only the first and second electrical blades 21 and 22.

The first and second electrical blades 21 and 22 and the ground lug 23 extend from the first plug housing portion 27 for insertion into a receptacle (not shown) of the power source 15. The receptacle (not shown) of the power source 15 has resilient mechanical connectors for engagement with the first and second electrical blades 21 and 22 and the ground lug 23 of the electrical plug 20 as should be well known to those skilled in the electrical art.

As best shown in FIGS. 3 and 4, a plug heat sensitive device 70 is located in a central region of the first housing portion 27. The plug heat sensitive device 70 is shown as negative temperature coefficient thermistor 70. The operation of a thermistor is disclosed in U.S. Pat. No. 2,021,491 should be well known to those skilled in the art. Although the plug heat sensitive device 70 is shown as a thermistor, it should be understood that various types of heat sensitive devices maybe used with the present invention.

The plug heat sensitive device 70 includes a first and a second lead 71 and 72. The first lead 71 of the plug heat sensitive device 70 is connected to the second conductor 42 or neutral conductor. The second lead 72 of the plug heat sensitive device 70 is connected to the plug sensor wire 44 of the power cable 40.

Figure 5:
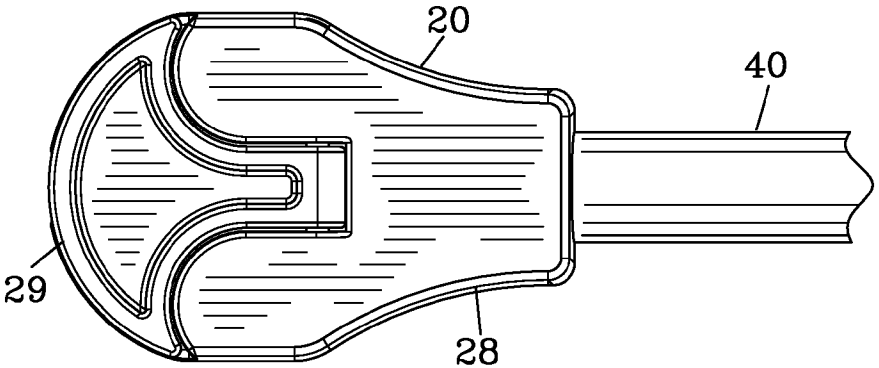
FIG. 5 is a view similar to FIG. 3 with a final second portion of the plug shown in FIG. 1.
Figure 6:
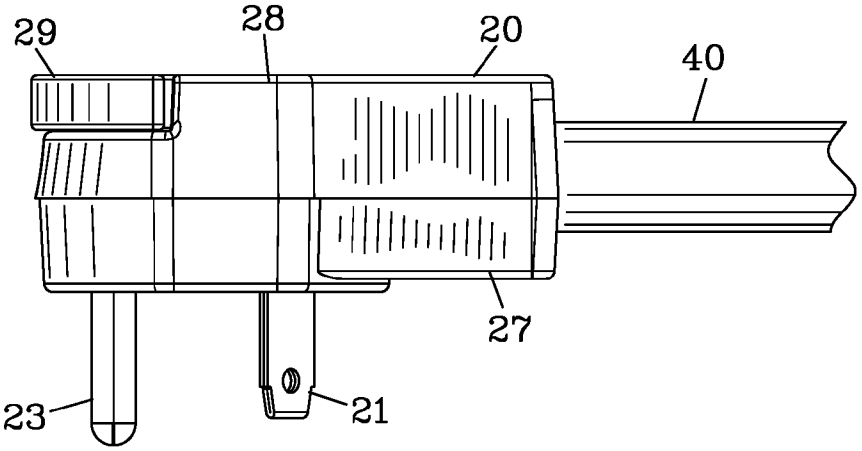
FIG. 6 is a side view of FIG. 5.

FIGS. 5 and 6 illustrate the plug 20 of FIGS. 3 and 4 with a second housing portion 28 molded to a first housing portion 27 of the electrical plug 20. The second housing portion 28 is bonded to the first housing portion 27 to immobilize further the first and second electrical blades 21 and 22 and the ground lug 23 within the plug 20. In addition, the second housing portion 28 molded to a first housing portion 27 immobilize the plug heat sensitive device 70 within the electrical plug 20. In this example, the electric plug 20 includes a handle 29 for removing the electrical plug 20 from the electrical source 20. A handle 29 is the subject matter of U.S. Pat. No. 8,641,443 and forms no part of the present invention.

The thermal conductivity of the first housing portion 27 and the second housing portion 28 transfer any heat from first and second electrical blades 21 and 22 to the plug heat sensitive device 70. Excess heat transferred from first and second electrical blades 21 and 22 to the plug heat sensitive device 70 is indicative of an elevated temperature condition at one of the first and second electrical blades 21 and 22.

The output of the plug heat sensitive device 70 is connected through the plug sensor wire 44 to the detection circuit 11 and the interruption circuit 12 contained in the closure 60. The operation of the detection circuit 11 and the interruption circuit 12 will be fully explained with reference to FIG. 11.

Figure 7:
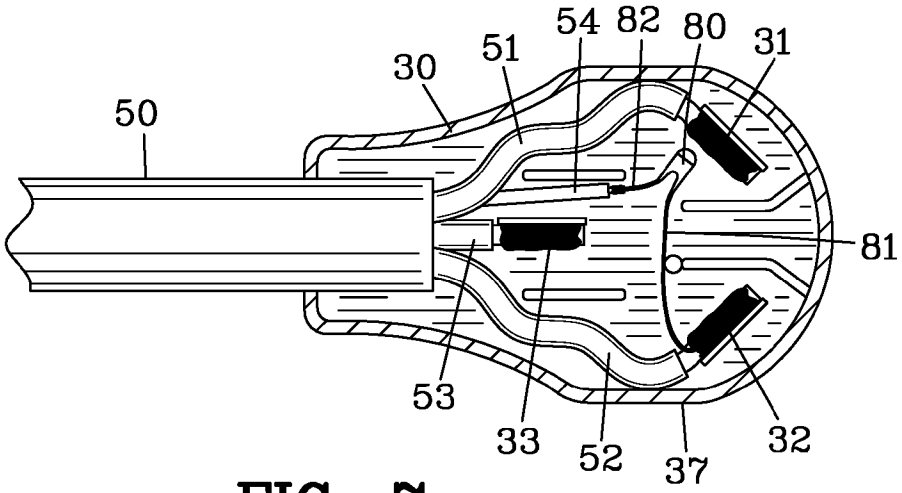
FIG. 7 is an enlarged view along line 7-7 in FIG. 2 showing an initial first portion of a receptacle shown in FIG. 1.
Figure 8:
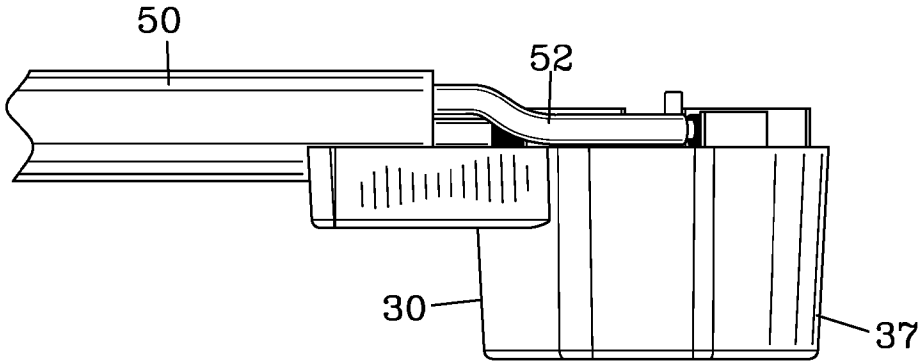
FIG. 8 is a side view of FIG. 7.

FIGS. 7 and 8 are enlarged interior views of the electrical receptacle 30 of FIGS. 1 and 2. The electrical receptacle 30 includes a first and a second electrical slots 31 and 32 and a ground socket 33. The first and second electrical slots 31 and 32 and the ground socket 33 are molded into a first housing portion 37 of the electrical receptacle 30.

The power cable 50 connects the electrical receptacle 30 to the closure 60. The power cable 50 comprises a first and a second conductor 51 and 52 and a ground conductor 53. The first and second slots 31 and 32 of the receptacle 30 are connected to the first and a second conductor 51 and 52 of the power cable 50. The ground socket 33 is connected to the ground conductor 53. The first conductor 51 is shown as a line conductor whereas the second conductor 52 is shown as a neutral conductor. The power cable 50 includes a receptacle sensor wire 54 the function of which will be described in greater detail hereinafter. Although the electrical receptacle 30 has been shown to include the ground socket 33, it should be understood that the present invention can be used with an electrical receptacle 30 having only the first and second electrical slots 31 and 32.

The first and second electrical slots 31 and 32 and the ground socket 33 extend from the first receptacle housing 37 for receiving the load 16. The first and second electrical slots 31 and 32 of the receptacle 30 have resilient mechanical connectors for engagement with the load 16 as should be well known to those skilled in the electrical art.

As best shown in FIGS. 7 and 8, a receptacle heat sensitive device 80 is located in a central region of the first receptacle housing portion 37. The receptacle heat sensitive device 80 is shown as negative temperature coefficient thermistor 80.

The receptacle heat sensitive device 80 includes a first and a second lead 81 and 82. The first lead 81 of the receptacle heat sensitive device 80 is connected to the second conductor 52 or neutral conductor. The second lead 82 of the receptacle heat sensitive device 80 is connected to the receptacle sensor wire 54 of the power cable 50.

Figure 9:
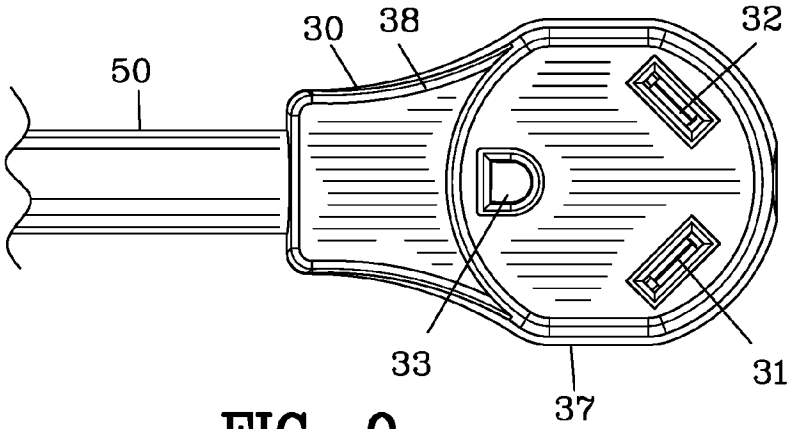
FIG. 9 is a view similar to FIG. 7 with a final second portion of the receptacle shown in FIG. 1.
Figure 10:
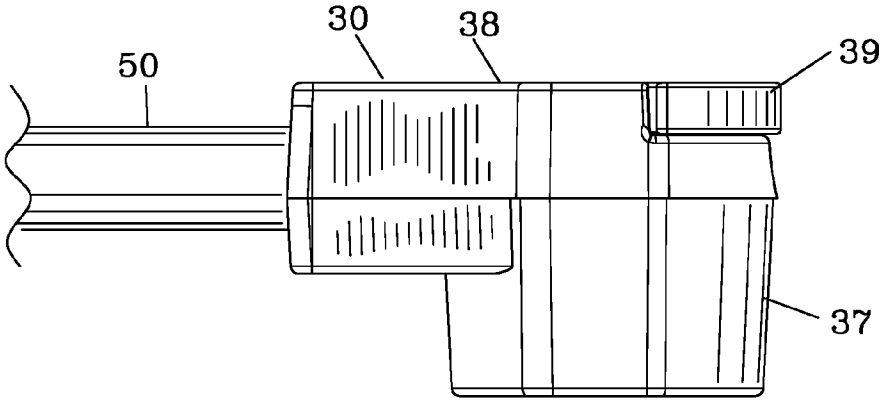
FIG. 10 is a side view of FIG. 9.

FIGS. 9 and 10 illustrate the receptacle 30 of FIGS. 7 and 8 with a second housing portion 38 molded to a first housing portion 37 of the electrical receptacle 30. The second housing portion 38 is bonded to the first housing portion 37 to immobilize further the first and second electrical slots 31 and 32 and the ground socket 33 within the receptacle 30. In addition, the second housing portion 38 molded to a first housing portion 37 immobilize the receptacle heat sensitive device 80 within the electrical receptacle 20. A handle 39 is the subject matter of U.S. Pat. No. 8,641,443 and forms no part of the present invention.

The thermal conductivity of the first housing portion 37 and the second housing portion 38 transfer any excessive heat from first and second electrical slots 31 and 32 to the receptacle heat sensitive device 80. Excess heat transferred from first and second electrical slots 31 and 32 to the receptacle heat sensitive device 80 is indicative of an elevated temperature at one of the first and second electrical slots 31 and 32.

The output of the receptacle heat sensitive device 80 is connected through the receptacle sensor wire 54 to the detection circuit 11 and the interruption circuit 12 contained in the closure 60. The operation of the detection circuit 11 and the interruption circuit 12 will be fully explained with reference to FIG. 11.

Figure 11:
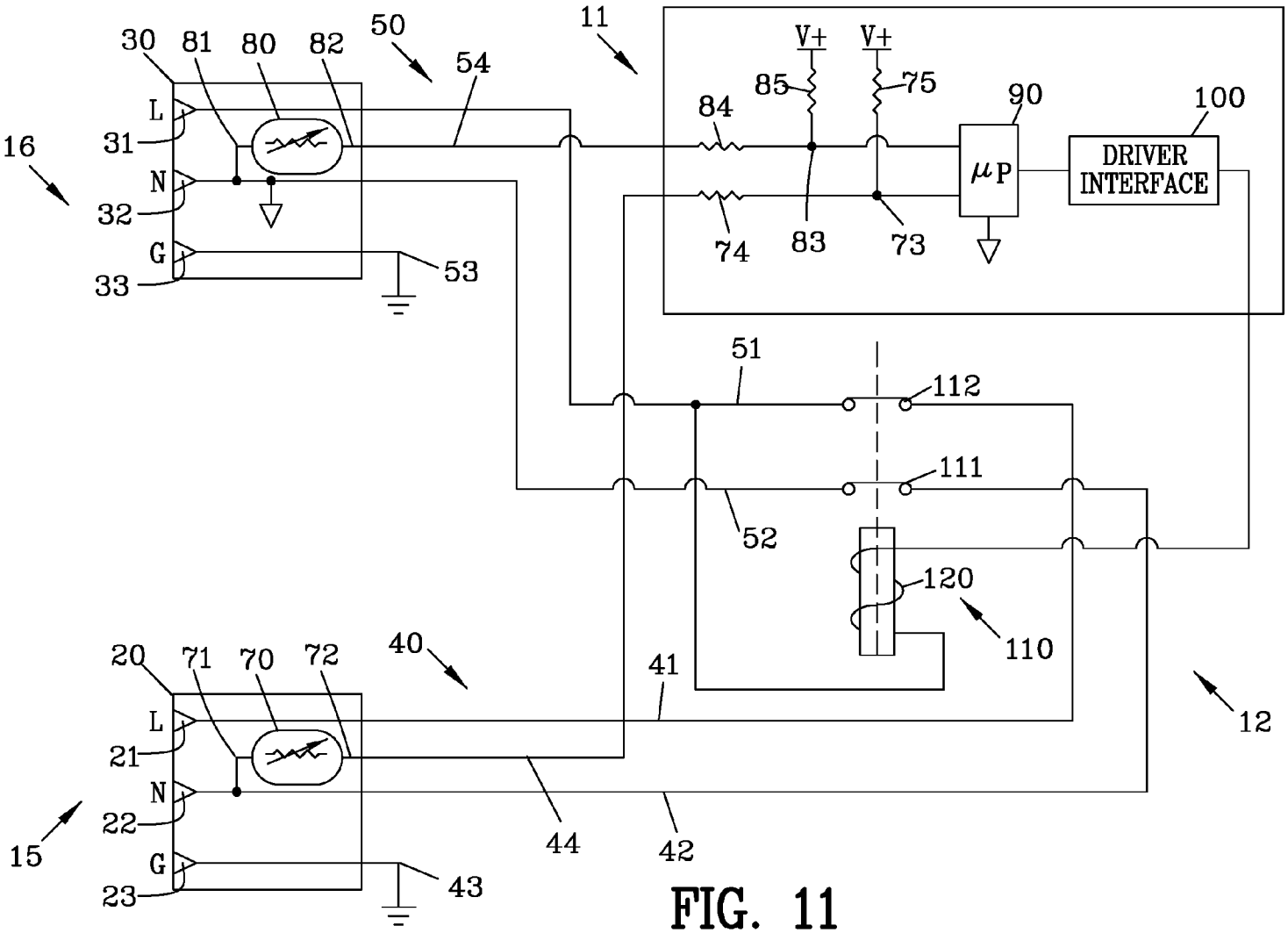
FIG. 11 is a block diagram of the elevated temperature detection and interrupter circuit of the present invention.

FIG. 11 is a block diagram of a first example of an elevated temperature detection circuit 10 comprising the detection circuit 11 and the interruption circuit 12 for disconnecting electrical power upon detecting an elevated temperature. The interruption circuit 12 disconnects electrical power upon detecting an elevated temperature to prevent an overheated condition.

The detection circuit 11 comprises the first and second heat sensitive devices 70 and 80 secured to the electrical plug 20 and the electrical receptacle 30 as heretofore described. The sensor conductors 44 and 54 connect the first and second heat sensitive devices 70 and 80 to the detection circuit 11.

The first heat sensitive device 70 of the electrical plug 20 is connected to a voltage divider network 73 comprising a resistor 74 and a resistor 75. The output of the voltage divider network 73 is connected to a first input to a microprocessor 90. The second heat sensitive device 80 of the electrical receptacle 30 is connected to a voltage divider network 83 comprising a resistor 84 and a resistor 85. The output of the voltage divider network 83 is connected to a second input to a microprocessor 90. A Microchip PIC16F1937 CMOS Microcontroller with 10-bit A/D converter is suitable for use as the microprocessor 90. The first and second input of the microprocessor 90 function as comparators to compare the output voltage of the voltage divider networks 73 and 83 to a reference voltage. The operation of a comparator circuit should be well known to those skilled in the art.

In the event the heat sensitive device 70 of the electrical plug 20 experiences an undesirable elevated temperature, the output of the voltage divider network 73 is elevated resulting in an output from the microprocessor 90 to a driver interface 100. In the event the heat sensitive device 80 of the electrical receptacle 30 experiences an undesirable elevated temperature, the output of the voltage divider network 83 is elevated resulting in an output from the microprocessor 90 to a driver interface 100.

An input to the driver interface 100 provides a suitable output to a disconnect switch 110. The disconnect switch 110 includes switches 111 and 112 operating in unison. The first and second electrical blades 21 and 22 of the electrical plug 20 shown in FIG. 2 are connected by power cable conductors 41 and 42 of the power cable 40 to a first side of the switches 1 and 112. Power cable conductors 51 and 52 of the power cable 50 connect the second side of switches 111 and 112 to an electrical receptacle 30. The disconnect switch 110 is shown in the closed or reset condition. The ground lug 23 is connected directly through the ground conductors 43 and 53 of the ground socket 33 of the electrical receptacle 30.

Figure 12:
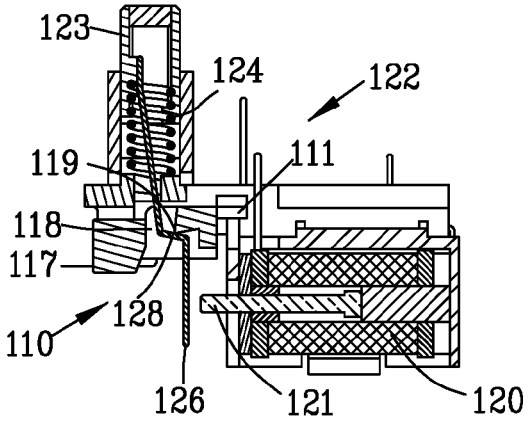
FIG. 12 is a sectional view illustrating an example of a disconnect switch in a closed position suitable for use in the present invention.
Figure 14:
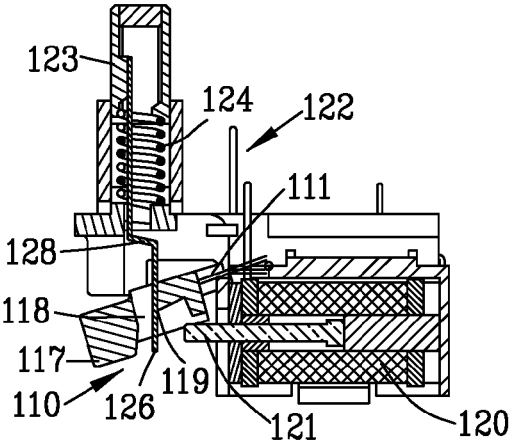
FIG. 14 is a sectional view of the disconnect switch of FIG. 12 in an open position.
Figure 13:
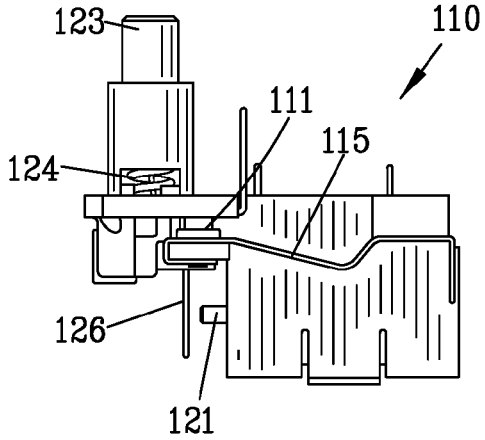
FIG. 13 is an elevational view of the disconnect switch of FIG. 12.
Figure 15:
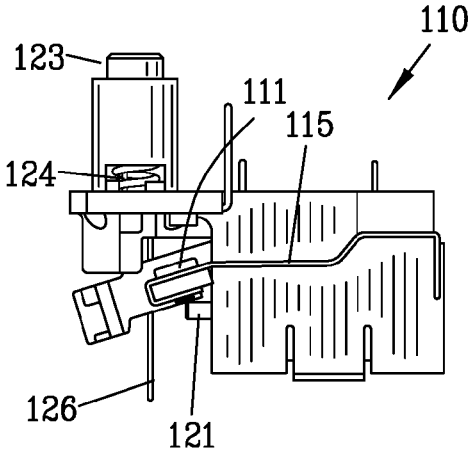
FIG. 15 is an elevational view of the disconnect switch of FIG. 14.

FIGS. 12-15 are enlarged sectional views of a disconnect switch 110 suitable for use as the disconnect switch of FIG. 11. FIGS. 12 and 13 illustrate the disconnect switch 110 in the closed position whereas FIGS. 14 and 15 illustrate the disconnect switch 110 in the open position. Resilient metallic conductors including resilient metallic conductor 115 bias the first and second switches 111 and 112 into an open position. An insulating switch operator 117 interconnects the first and second switches 111 and 112 for moving the first and second switches 111 and 112 in unison. The insulating switch operator 117 includes an aperture 118 defining a shoulder 119. The disconnect switch 110 includes the solenoid coil 120 for operating a plunger 121. The plunger 121 is located for movement adjacent to the aperture 118 in the insulating switch operator 117. A latch 122 is shown as a mechanical latch comprising a reset button 123 having a return spring 124. A latch bar 126 having a latch shoulder 128 is connected to the reset button 123.

FIGS. 12 and 13 illustrate the disconnect switch 110 in the closed position. The latch shoulder 128 of the latch bar 126 engages with the shoulder 119 defined by the aperture 118 of the switch operator 117. The return spring 124 is selected to be stronger than the resilient metallic conductors including resilient metallic conductor 115 biasing the first and second switches 111 and 112 into an open position. The return spring 124 retains the first and second switches 111 and 112 in the closed position against the urging of the resilient metallic conductors 115 and 116.

FIGS. 14 and 15 illustrate the disconnect switch 110 in an open position. An electrical current through the solenoid coil 120 extends the plunger 121 to displace the latch bar 126. The plunger 121 displaces the latch bar 126 to disengage the latch shoulder 128 of the latch bar 126 from the shoulder 117 of the switch operator 115. The disengagement of the latch shoulder 128 from the shoulder 119 permits the resilient metallic conductors 115 and 116 to move the first and second switches 111 and 112 into the open position. The first and second switches 111 and 112 remain in the open position until the disconnect switch 110 is manually reset by the reset button 123. Concomitantly therewith, the return spring 124 moves the reset button 123 into an extended position. The latch bar 126 and the latch shoulder 128 move in unison with the reset button 123.

The disconnect switch 110 is reset by depressing the reset button 123 against the urging of the return spring 124. The latch shoulder 128 of the latch bar 126 reengages with the shoulder 119 of the switch operator 117. The reset button 123 moves the first and second switches 111 and 112 into the closed position against the urging of the resilient metallic conductors 115 and 116.

Although the disconnect switch 110 has been shown as a normally open, latch closed solenoid mechanism, it should be appreciated by those skilled in the art that various types of mechanical and or electrical switches may be utilized within the present invention for providing the structure and function of the disconnect switch 110.

Referring back to FIG. 11, under a normal operating temperature condition, the resistance of the first sensitive devices 70 in combination with the resistors 74 and 75 produce a voltage at the of the voltage divider 73 that is insufficient to trigger the an output from the microprocessor 90 to the driver interface 100. Similarly, under a normal operating temperature condition, the resistance of the sensitive devices 80 in combination with the resistors 84 and 85 produce a voltage at the of the voltage divider 83 that is insufficient to trigger the an output from the microprocessor 90 to the driver interface 100.

In the event one of the first and second electrical blades 21 and 22 of the electrical plug 20 undergoes an undesirable elevated temperature, then the elevated temperature is thermally transferred to the heat sensitive device 70. The resistance of the heat sensitive device 70 is reduced thereby increasing the voltage at the voltage divider 73. The elevation of voltage at the voltage divider 73 triggers an output from the microprocessor 90 to the driver interface 100. The driver interface 100 provides a current flow through coil 120 to actuate the plunger 121 to open disconnect switch 110 as shown in FIGS. 14 and 15. The opening of the disconnect switch 110 terminates current flow from the electrical plug 20 to the electrical receptacle 30 to prevent an overheated condition.

In the event one of the first and second electrical slots 31 and 32 of the electrical receptacle 30 undergoes an undesirable elevated temperature, then the elevated temperature is thermally transferred to the heat sensitive device 80. The resistance of the heat sensitive device 80 is reduced thereby increasing the voltage at the voltage divider 83. The elevation of voltage at the voltage divider 83 trigger an output from the microprocessor 90 to the driver interface 100. The driver interface 100 provides a current flow through coil 120 to actuate the plunger 121 to open disconnect switch 110 as shown in FIG. 13. The opening of the disconnect switch 110 terminates current flow from the electrical plug 20 to the electrical receptacle 30 to prevent an overheated condition.

Figure 16:
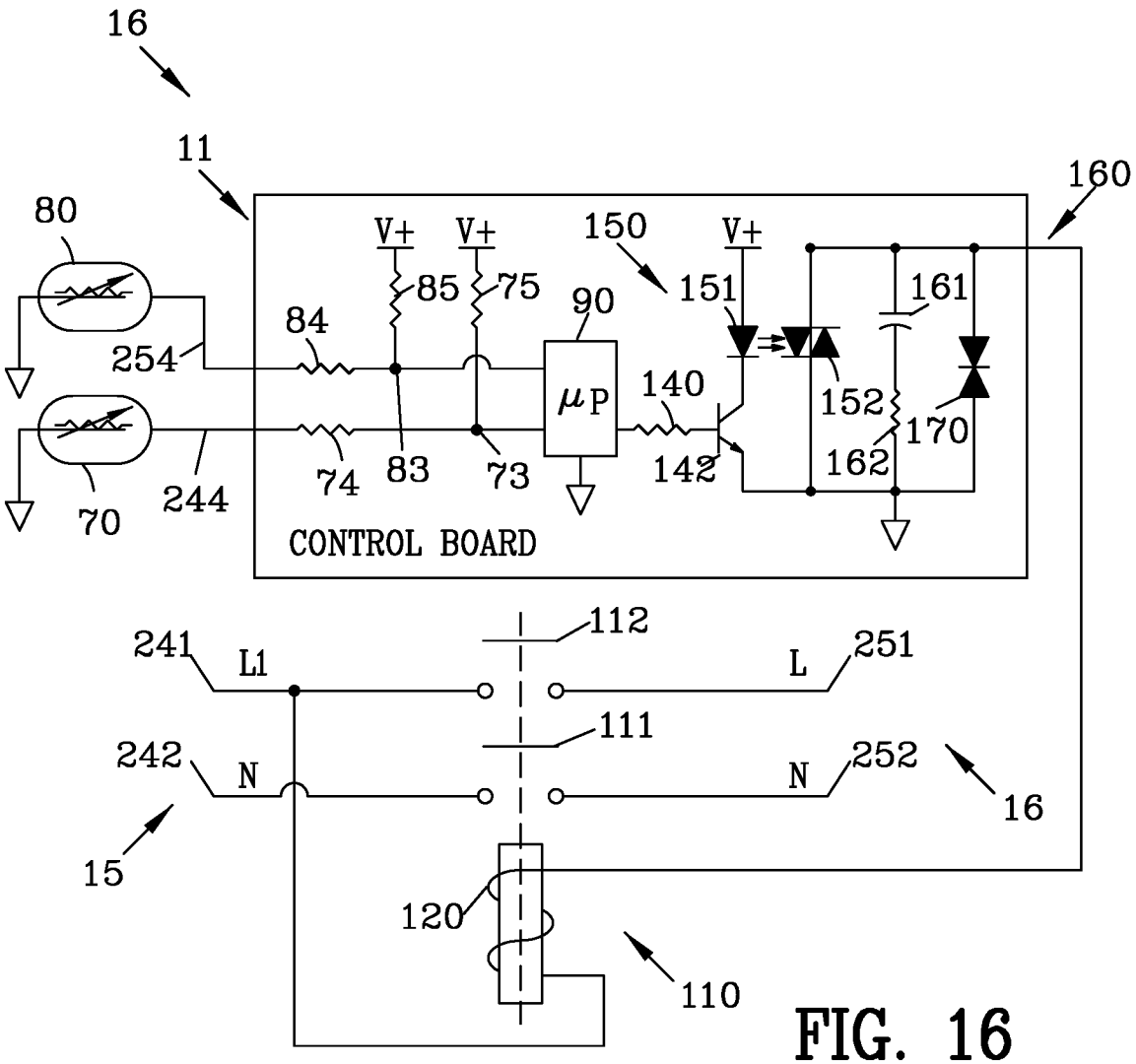
FIG. 16 is a circuit diagram of a portion of FIG. 11.

FIG. 16 is a circuit diagram of a portion of FIG. 11 further illustrating the driver 100 of FIG. 11. The output of microprocessor 90 is applied through resistor 140 to a transistor 142. An opto-isolator 150 comprises a light emitting diode 151 optically coupled to a photo conductive switch 152 shown as a light sensitive TRIAC. The light emitting diode 151 is positioned in the collector circuit of the transistor 140. Although, the opto-isolator 150 has been shown with a light emitting diode 151 coupled to a photo conductive switch 152, it should be appreciated by those skilled in the art that various other photosensitive switches and light emitting devices may be used with the present invention.

In the event of an elevated temperature in either the electrical plug 20 or the electrical receptacle 30, an output of microprocessor 90 causes conduction of transistor 142 to illuminate the light emitting diode 151. The illumination of the light emitting diode 151 results in conduction of photo conductive switch 152 to energize coil 120 thus operating plunger 121 to move switches 111 and 112 into the open position as shown in FIGS. 14 and 15. A RC filtering circuit 160 comprising capacitor 161 and resistor 162 is connected across the photo conductive switch 152. A back to back diode 170 reduces inductive spikes from the inductive load of the coil 120.

Figure 17:
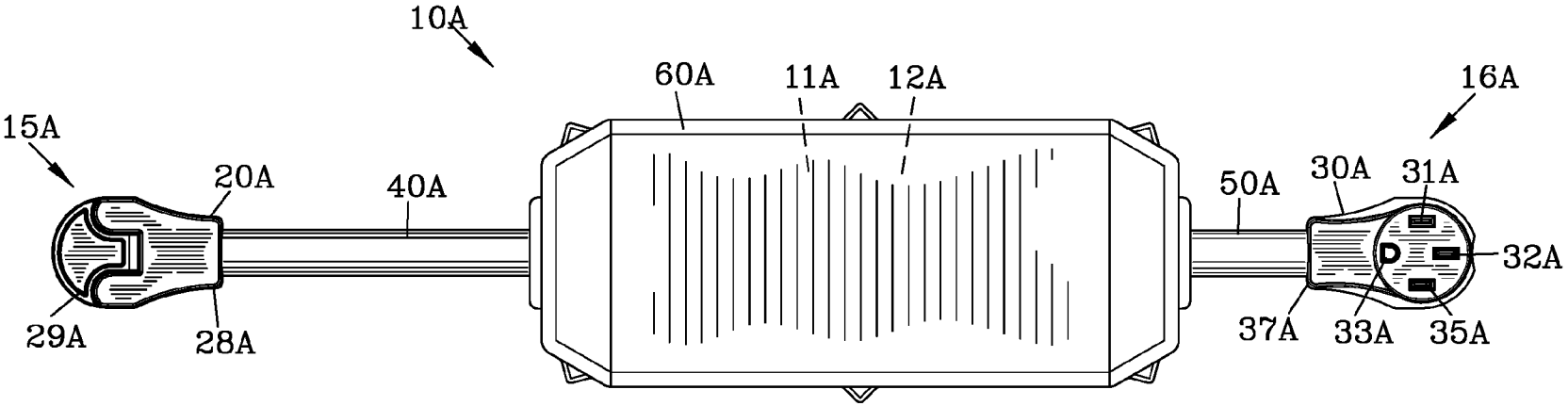
FIG. 17 is a top view of a second embodiment of a power cable incorporating an elevated temperature detection and interrupter circuit incorporating the present invention.
Figure 18:
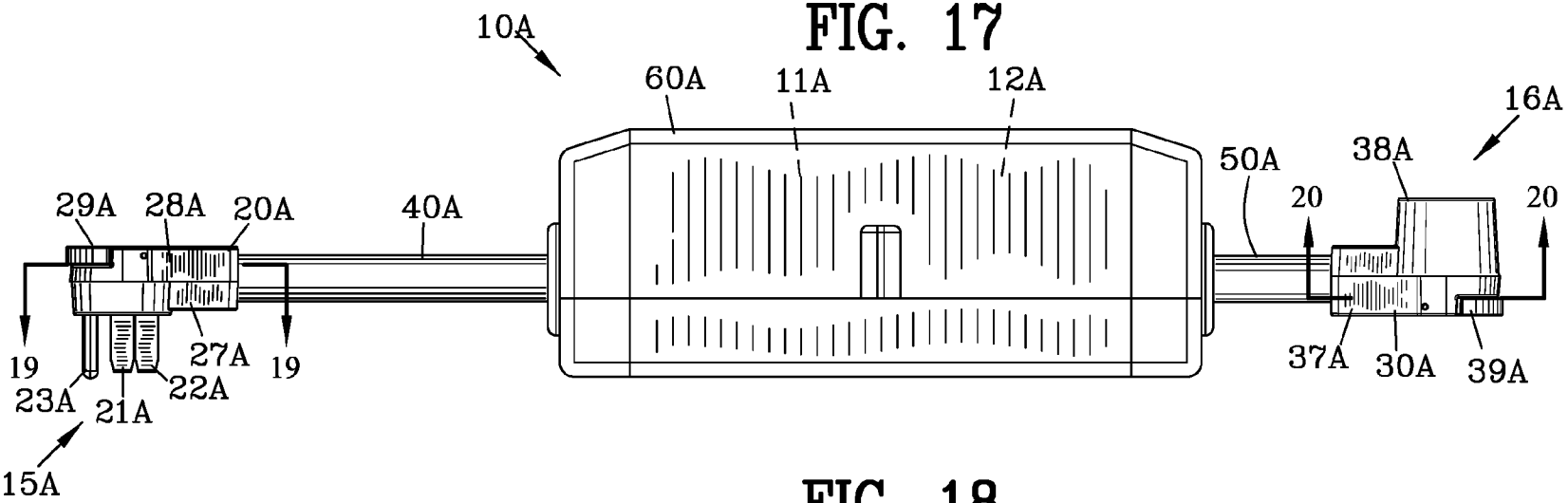
FIG. 18 is a side view of FIG. 17.

FIGS. 17 and 18 illustrate a second embodiment of an elevated temperature detection and interruption circuit 10A of the present invention. Similar components are labeled with similar reference numerals with the sequential alphabetical character A. In this embodiment, the elevated temperature detection and interruption circuit 10A is adapted to be connected to a conventional 240 volt 50 ampere power source 15A. The electrical receptacle 30 is adapted to be connected to a conventional 240 volt 50 ampere load 16A.

Figure 19:
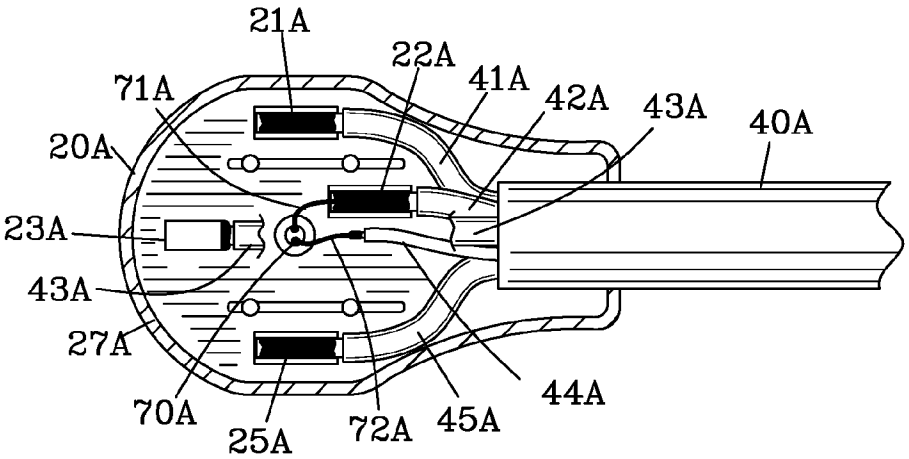
FIG. 19 is an enlarged view along line 19-19 in FIG. 18 showing an initial first portion of a plug shown in FIGS. 17 and 18.

FIG. 19 is an enlarged interior view of the electrical plug 20A of FIGS. 17 and 18. The electrical plug 20A includes a first and a second electrical blade 21A and 22A and a ground lug 23A. A third blade 25A is present in the electrical plug 20A to accommodate a 240 volt 50 ampere electrical service.

The first and second electrical blades 21A and 22A and the ground lug 23A as well as the third blade 35A are molded into a first housing portion 27A of the electrical plug 20A.

The power cable 40A connects the electrical plug 20A to the closure 60A. The power cable 40A comprises a first and a second conductor 41A and 42A and a ground conductor 43A as well as a third conductor 25A. The first, second and third blades 21A, 22A and 25A of the plug 20A are connected to the first, second and third conductors 41A, 42A and 45A of the power cable 40A. The ground lug 23A of the plug 20A is connected to the ground conductor 43A. The first conductor 41A and the third conductor 45A are shown as a line conductor whereas the second conductor 42A is shown as a neutral conductor. The power cable 40A includes a plug sensor wire 44A A plug heat sensitive device 70A is located in a central region of the first housing portion 27A. The plug heat sensitive device 70A includes a first and a second lead 71A and 72A. The first lead 71A of the plug heat sensitive device 70A is connected to the second conductor 42A or neutral conductor. The second lead 72A of the plug heat sensitive device 70A is connected to the plug sensor wire 44A of the power cable 40A.

A second housing portion (not shown) is molded to the first housing portion 27A of the electrical plug 20A in a manner as shown in FIGS. 5 and 6. The second housing portion (not shown) immobilizes the first, second and third electrical blades 21A, 22A and 25A and the ground lug 23A as well as the plug heat sensitive device 70 within the plug 20A.

Figure 20:
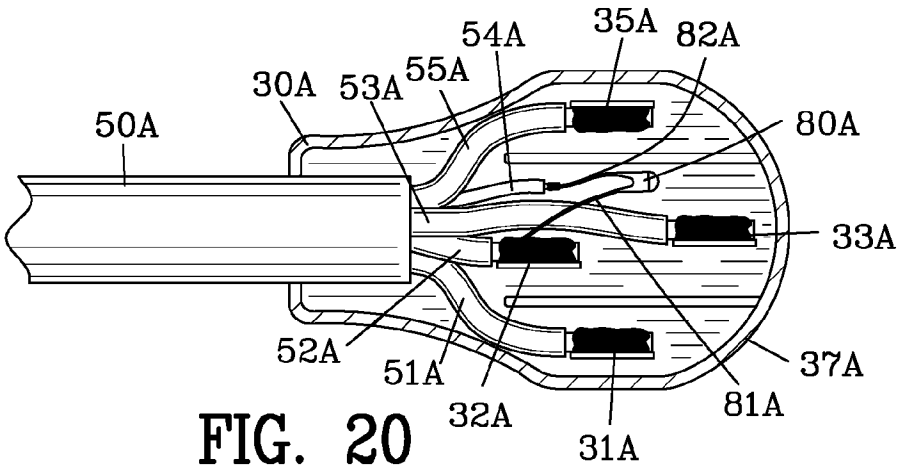
FIG. 20 is an enlarged view along line 20-20 in FIG. 18 showing an initial first portion of a receptacle shown in FIGS. 17 and 18.

FIG. 20 is an enlarged interior view of the electrical receptacle 30A of FIGS. 17 and 18. The electrical receptacle 30A includes a first and a second electrical slot 31A and 32A and a ground lug 33A. A third slot 35A is present in the electrical receptacle 30A to accommodate for the 240 volt 50 ampere electrical service.

The first and second electrical slots 31A and 32A and the ground lug 33A as well as the third slot 35A are molded into a first housing portion 37A of the electrical receptacle 30A.

The power cable 50A connects the electrical receptacle 30A to the closure 60A. The power cable 50A comprises a first and a second conductor 51A and 52A and a ground conductor 53A as well as a third conductor 55A. The first, second and third slots 31A, 32A and 35A of the receptacle 30A are connected to the first, second and third conductors 51A, 52A and 55A of the power cable 50A. The ground socket 33A of the receptacle 30A is connected to the ground conductor 53A. The first conductor 51A and the third conductor 55A are shown as a line conductor whereas the second conductor 52A is shown as a neutral conductor. The power cable 50A includes a plug sensor wire 54A A receptacle heat sensitive device 80A is located in a central region of the first housing portion 37A. The receptacle heat sensitive device 80A includes a first and a second lead 81A and 82A. The first lead 81A of the receptacle heat sensitive device 80A is connected to the second conductor 52A or neutral conductor. The second lead 82A of the receptacle heat sensitive device 80A is connected to the receptacle sensor wire 54A of the power cable 50A.

A second housing portion (not shown) is molded to the first housing portion 37A of the electrical receptacle 30A in a manner as shown in FIGS. 9 and 10. The second housing portion (not shown) immobilizes the first, second and third electrical slots 31A, 32A and 35A and the ground lug socket 33A as well as the receptacle heat sensitive device 80A within the receptacle 30A.

The plug heat sensitive device 70A and the receptacle heat sensitive device 80A are connected to a detection circuit 11 and interruption circuit 12 similar to FIG. 11. Preferably, the disconnect switch 110 in FIG. 11 incorporates an additional switch for disconnecting the first, second and third conductors 41A, 42A and 45A of the power cable 40A.

Figure 21:
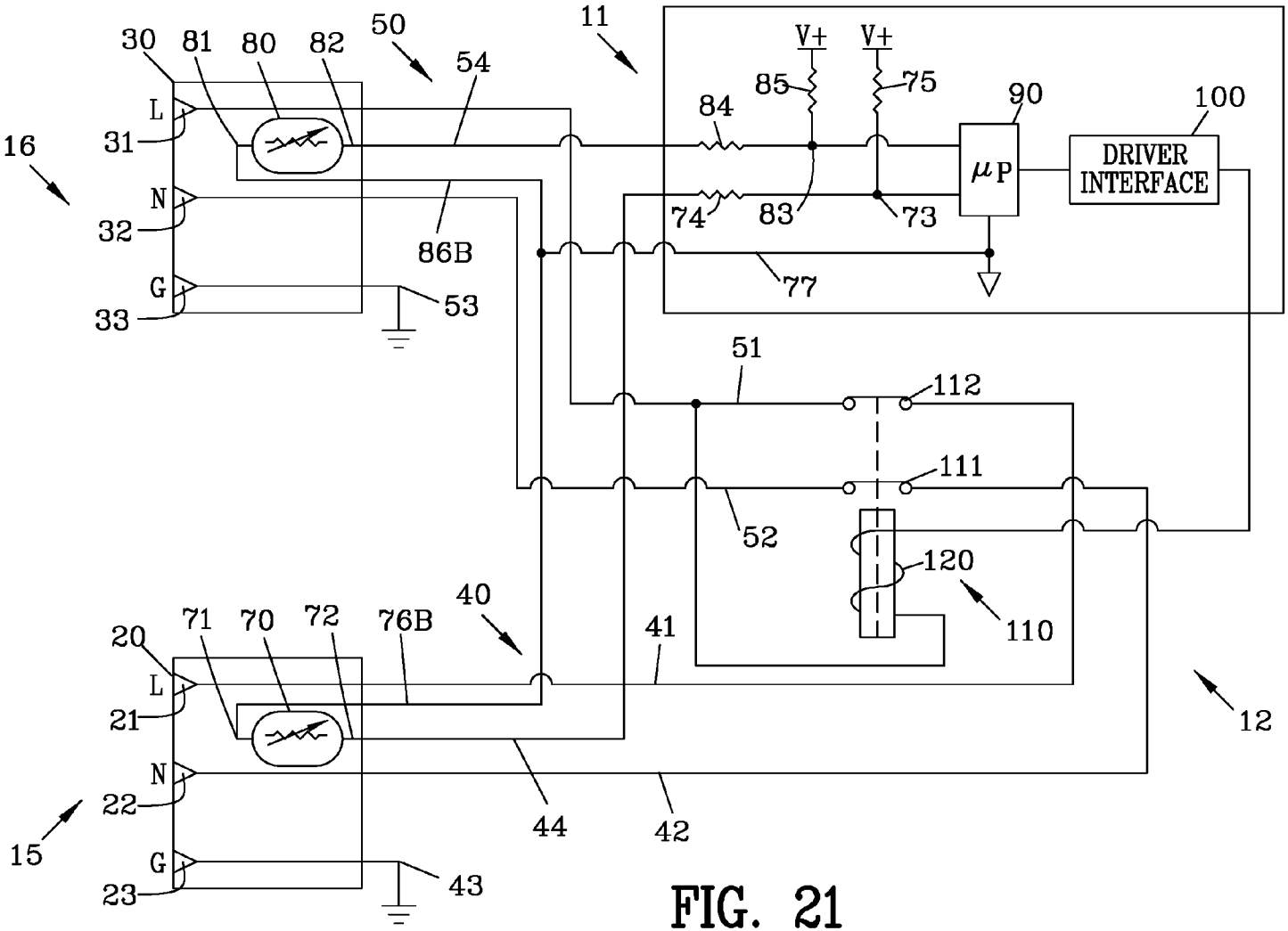
FIG. 21 is a block diagram of a variation of the elevated temperature detection and interrupter circuit shown in FIG. 11.

FIG. 21 is a block diagram of a variation of the elevated temperature detection circuit shown 10 in FIG. 11. Similarly components are labeled with similar reference numerals.

The elevated temperature detection circuit 10B comprises an electrical plug 20B and an electrical receptacle 30B detection circuit 11 and the interruption circuit 12 interposed therebetween. The elevated temperature detection circuit 101B disconnects electrical power upon detecting an elevated temperature in either the electrical plug 20B and/or the electrical receptacle 30B.

The plug heat sensitive device 70B includes a first and a second lead 71B and 72B. In contrast to the elevated temperature detection circuit shown in FIG. 11, the first lead 71B of the plug heat sensitive device 70B is connected to a conductor 76B and a conductor 77B to a ground located in the detection circuit 11. The second lead 72 of the plug heat sensitive device 70 is connected to the plug sensor wire 44 of the power cable 40.

The receptacle heat sensitive device 80 includes a first and a second lead 81 and 82. The first lead 81 of the receptacle heat sensitive device 80 is connected to a conductor 86B and the conductor 77B to the ground located in the detection circuit 11. The second lead 82 of the receptacle heat sensitive device 80 is connected to the receptacle sensor wire 54 of the power cable 50.

In contrast to the elevated temperature detection circuit shown in FIG. 11, the plug heat sensitive device 70B and the receptacle heat sensitive device 80 of FIG. 21 are totally isolated from the power cables 40 and 50. The remainder of the detection circuit 11 and the interruption circuit 12 operate in a manner as previously described with reference to FIG. 11

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claims is:

1. A circuit for disconnecting electrical power upon the detection of an elevated temperature, comprising:

an electrical plug adapted for insertion in an electrical power source;

an electrical receptacle adapted for receiving an electrical load;

a power cable interconnecting said electrical plug and said electrical receptacle;

an interruption circuit having a disconnect switch interposed in said power cable;

a plug heat sensitive device secured to said electrical plug for monitoring the temperature of the electrical plug;

a receptacle heat sensitive device secured to electrical receptacle for monitoring the temperature of the electrical receptacle; and an elevated temperature detection circuit connected to said plug heat sensitive device and said receptacle heat sensitive device for opening said disconnect switch upon said elevated temperature detection circuit detecting an elevated temperature in one of said electrical plug and said electrical receptacle to prevent an overheated condition.

2. A circuit as set forth in claim 1, wherein said disconnect switch is located external to said electrical plug and said electrical receptacle and interposed in said power cable between said electrical plug and said electrical receptacle.

3. A circuit as set forth in claim 1, wherein said disconnect switch is located external to said electrical plug and said electrical receptacle and interposed in said power cable between said electrical plug and said electrical receptacle; and said elevated temperature detection circuit being located adjacent to said disconnect switch.

4. A circuit as set forth in claim 1, wherein said electrical plug comprises an electrical plug housing with said plug heat sensitive device being located in a generally central portion of said electrical plug housing; and said electrical receptacle comprises an electrical receptacle housing with said receptacle heat sensitive device being located in a generally central portion of said electrical receptacle housing.

5. A circuit as set forth in claim 1, wherein said electrical plug comprises an electrical plug housing supporting a first and a second electrical blade for insertion within a first and a second slot of the power source;

said plug heat sensitive device located in said electrical plug housing for monitoring the temperature of each of said first and second electrical blades;

said electrical receptacle comprises an electrical receptacle housing supporting a first and a second electrical slot for receiving the electrical load;

said receptacle heat sensitive device located in said electrical receptacle housing for monitoring the temperature of each of said first and second electrical slots.

6. A circuit as set forth in claim 1, wherein said elevated temperature detection circuit includes a plug voltage divider circuit and a receptacle divider circuit;

said plug heat sensitive device comprises a plug thermistor connected between a neutral line and said plug voltage divider circuit of said elevated temperature detection circuit; and said receptacle heat sensitive device comprises a receptacle thermistor connected between a neutral line and said receptacle voltage divider circuit of said elevated temperature detection circuit.

7. A circuit as set forth in claim 1, wherein said elevated temperature detection circuit includes a plug voltage divider circuit and a receptacle divider circuit;

said plug heat sensitive device comprises a plug thermistor connected between a neutral line and said plug voltage divider circuit of said elevated temperature detection circuit;

said receptacle heat sensitive device comprises a receptacle thermistor connected between a neutral line and said receptacle voltage divider circuit of said elevated temperature detection circuit;

said elevated temperature detection circuit including a microprocessor circuit having an input gate; and said plug voltage divider circuit and a receptacle divider circuit connected to said input gate of said microprocessor circuit.

8. A circuit as set forth in claim 1, wherein said elevated temperature detection circuit includes a plug voltage divider circuit and a receptacle divider circuit;

said plug heat sensitive device comprises a plug thermistor connected to said plug voltage divider circuit of said elevated temperature detection circuit;

said receptacle heat sensitive device comprises a receptacle thermistor connected to said receptacle voltage divider circuit of said elevated temperature detection circuit;

said elevated temperature detection circuit including a microprocessor circuit having an input gate; and said plug voltage divider circuit and a receptacle divider circuit connected to said input gate of said microprocessor circuit.

9. A circuit as set forth in claim 1, wherein said disconnect switch comprises a spring loaded relay switch.

10. A circuit as set forth in claim 1, including a closure located between said electrical plug and said electrical receptacle for housing said elevated temperature detection circuit and said interruption circuit.

11. A circuit for disconnecting electrical power upon the detection of an elevated temperature condition, comprising:

a electrical plug including an electrical plug housing supporting a first and a second electrical blade for insertion within a the power source;

a plug heat sensitive device located in said electrical plug housing for monitoring the temperature of each of said first and second electrical blades;

an electrical receptacle including an electrical receptacle housing supporting a first and a second electrical slot for receiving the electrical load;

a receptacle heat sensitive device located in said electrical receptacle housing for monitoring the temperature of each of said first and second electrical slots, a power cable interconnecting said electrical plug and said electrical receptacle;

an interruption circuit having a disconnect switch located external to said electrical plug and said electrical receptacle and interposed in said power cable;

a plug heat sensitive device located in said electrical plug housing for monitoring the temperature of each of said first and second electrical blades;

a receptacle heat sensitive device located in said electrical receptacle housing for monitoring the temperature of each of said first and second electrical slots; and an elevated temperature detection circuit connected to said plug heat sensitive device and said receptacle heat sensitive device for opening said disconnect switch upon said elevated temperature detection circuit detecting an overheated condition in one of said electrical plug and said electrical receptacle to prevent an overheated condition.

12. A circuit for disconnecting electrical power as set forth in claim 11, wherein said elevated temperature detection circuit includes a plug voltage divider circuit and a receptacle divider circuit;

said plug heat sensitive device comprises a plug thermistor connected between a neutral line and said plug voltage divider circuit of said elevated temperature detection circuit; and said receptacle heat sensitive device comprises a receptacle thermistor connected between a neutral line and said receptacle voltage divider circuit of said elevated temperature detection circuit.

13. A circuit for disconnecting electrical power as set forth in claim 11, wherein said elevated temperature detection circuit includes a plug voltage divider circuit and a receptacle divider circuit;

said plug heat sensitive device comprises a plug thermistor connected to said plug voltage divider circuit of said elevated temperature detection circuit; and said receptacle heat sensitive device comprises a receptacle thermistor connected to said receptacle voltage divider circuit of said elevated temperature detection circuit.

14. A circuit for disconnecting electrical power as set forth in claim 11, wherein said elevated temperature detection circuit includes a plug voltage divider circuit and a receptacle divider circuit;

said plug heat sensitive device comprises a plug thermistor connected to said plug voltage divider circuit of said elevated temperature detection circuit;

said receptacle heat sensitive device comprises a receptacle thermistor connected to said receptacle voltage divider circuit of said elevated temperature detection circuit;

said elevated temperature detection circuit including a microprocessor circuit having an input gate; and said plug voltage divider circuit and a receptacle divider circuit connected to said input gate of said microprocessor circuit.

15. A circuit for disconnecting electrical power as set forth in claim 11, wherein said disconnect switch comprises a spring loaded relay switch.

16. A circuit for disconnecting electrical power as set forth in claim 11, including a closure located between said electrical plug and said electrical receptacle for housing said elevated temperature detection circuit and said interruption circuit.

17. A method of forming an electrical plug with a plug heat sensitive device for detecting an elevated temperature, comprising the steps of:

molding a first housing portion of the electrical plug from a polymeric material;

inserting a first and a second electrical blade into the first housing portion of the electrical plug;

connecting a power cable to the first and second electrical blades;

positioning the plug heat sensitive device adjacent to the first and second electrical blades;

connecting the plug heat sensitive device to the power cable; and molding a second housing portion onto the first housing portion to capture the first and second electrical blades and the plug heat sensitive device within the electrical plug.

18. A method of forming an electrical receptacle with a receptacle heat sensitive device for detecting an elevated temperature, comprising the steps of:

molding a first housing portion of the electrical receptacle from a polymeric material;

inserting a first and a second electrical slot into the first housing portion of the electrical receptacle;

connecting a power cable to the first and second electrical slots;

positioning the receptacle heat sensitive device adjacent to the first and second electrical slots;

connecting the receptacle heat sensitive device to the power cable; and molding a second housing portion onto the first housing portion to capture the first and second electrical slots and the receptacle heat sensitive device within the electrical receptacle.

* * * * *